US006855098B2

(12) United States Patent
Reitz et al.

(10) Patent No.: US 6,855,098 B2
(45) Date of Patent: Feb. 15, 2005

(54) LOW-RESISTANCE EXERCISE AND REHABILITATION CHAIR

(76) Inventors: Alan S. Reitz, 302 Buchanan St., Staunton, VA (US) 24401; Paxton P. Powers, 9 Waverly Green, Staunton, VA (US) 24401; Ronald O. Browne, 47 Lockheed Blvd., Waynesboro, VA (US) 22980

( * ) Notice: Subject to any disclaimer, the term of this patent is extended or adjusted under 35 U.S.C. 154(b) by 171 days.

(21) Appl. No.: 10/147,666

(22) Filed: May 17, 2002

(65) Prior Publication Data

US 2003/0216231 A1 Nov. 20, 2003

(51) Int. Cl.[7] ..... A63B 26/00

(52) U.S. Cl. ..... 482/142; 482/148; 482/140; 482/908; 297/68; 297/258.1; D12/52; D06/334

(58) Field of Search ..... 482/142, 908, 482/140, 1; 297/68, 258.1; D06/334; D12/52

(56) References Cited

U.S. PATENT DOCUMENTS

| | | | | | |
|---|---|---|---|---|---|
| 21,536 | A | * | 9/1858 | Holmes | 297/68 |
| 2,233,797 | A | * | 3/1941 | Potter | 297/68 |
| 4,723,537 | A | | 2/1988 | Parker, Jr. | |
| 4,827,913 | A | | 5/1989 | Parker | |
| 4,836,536 | A | * | 6/1989 | Jones | 482/134 |
| 4,921,247 | A | | 5/1990 | Sterling | |
| 5,163,451 | A | | 11/1992 | Grellas | |
| 5,258,019 | A | * | 11/1993 | Riddle et al. | 606/242 |
| 5,383,712 | A | | 1/1995 | Perry | |
| 5,865,457 | A | | 2/1999 | Knabusch et al. | |
| 5,931,535 | A | * | 8/1999 | Sweet | 297/354.13 |
| 6,135,554 | A | * | 10/2000 | Tsun et al. | 297/327 |

* cited by examiner

*Primary Examiner*—Nicholas D. Lucchesi
*Assistant Examiner*—L. Amerson
(74) *Attorney, Agent, or Firm*—Dale J. Ream

(57) ABSTRACT

An exercise and rehabilitation chair includes a framework having lower frame members, pivotal front legs, and elongate rear legs. The chair includes a seat assembly having a seat bottom and seat back and upper arms, each upper arm being pivotally coupled at one end to a generally upstanding support arm and at an opposed end to a front leg. Bearing housings pivotally connect corresponding support arms and rear legs and establish a fulcrum about which the seat assembly may rotate. The bearing housings may be slidably positioned longitudinally along corresponding support arms and rear legs using pin fasteners or, alternatively, using motorized gear assemblies. The displacement of the fulcrum relative to a user's hips is adjustable for regulating the resistance of chair operation. A foot assembly is pivotally coupled to the front legs. All pivotal connections correspond anatomically to a user's joints for low joint stress and low-resistance exercise.

17 Claims, 7 Drawing Sheets

LOW-RESISTANCE EXERCISE AND REHABILITATION CHAIR

BACKGROUND OF THE INVENTION

This invention relates generally to exercise and rehabilitation equipment and, more particularly, to a chair having multiple pivot points corresponding generally to a person's joints for low-resistance, high-repetition exercise and rehabilitation.

Elderly and disabled persons, persons confined to a small apartment or room, and persons recovering from injury, illness, or surgery frequently experience increased weakness and lack of steadiness and mobility. Lack of activity due to arthritis pains, senile dementia, and the like may also result in decreased strength and endurance. This weakening process may become a permanent physical limitation, result in falls, or require medical intervention, prolonged physical therapy, or living assistance.

Various exercise devices are known in the art for increasing muscle strength and aerobic endurance. Although assumably effective for their intended purposes, the existing devices may result in muscle soreness and joint pain as well as being difficult for the elderly or disabled to operate.

Therefore, it is desirable to have an exercise and rehabilitation chair having multiple pivot points that operate a user's joints using low-resistance and high repetition movements, without the user's body weight being applied to the joints, as is obvious by the user's sitting position. Further, it is desirable to have an exercise and rehabilitation chair in which resistance may be regulated by adjusting the vertical position of the fulcrum about which the seat assembly pivots. It is also desirable to have an exercise and rehabilitation chair in which the fulcrum may alternatively be adjusted using electrically actuated gear assemblies.

SUMMARY OF THE INVENTION

Accordingly, a low-resistance exercise and rehabilitation chair according to the present invention includes a framework having a pair of lower frame members with a pair of front legs pivotally coupled to front ends thereof. A pair of A-frame supports are fixedly attached to respective lower frame members with one rear leg extending higher than the other. The chair includes a seat assembly having a pair of upper arms. A front end of each upper arm is pivotally coupled to upper ends of respective front legs. Rear ends of the upper arms are pivotally coupled to respective generally upstanding support arms. The support arms are pivotally coupled to the rigid rear legs so as to establish a fulcrum about which the seat assembly may pivot in operation. The fulcrum is positioned generally only slightly above the hips of a user, the resistance of operation being easier the closer the fulcrum is to the hips and vice versa. Bearing housings mounted to the support arms and rigid rear legs are adapted to allow this fulcrum to be vertically adjusted.

A foot assembly is pivotally coupled to the front legs and includes a foot plate. Application of foot pressure against the foot plate along with back pressure against the seat back of the seat assembly causes the pivotal action/rocking motion of the seat assembly. Pivot points at the junction of the front legs and upper arms of the seat assembly, at the junction of the front legs and foot assembly, and at the junction of the seat bottom and seat back are configured to correspond most particularly with the knee and hip joints of a user. In addition, the configuration of the fulcrum just above the hips of a user reduces resistance during operation. The pivotal attachment of the front legs to respective rigid lower frame members also contributes to the smooth, low-resistance operation of the apparatus. Since the configuration of the chair does not stress a user's joints and provides low resistance due to the proximity of the fulcrum to the user's hips, the chair provides exercise or rehabilitation to a user without the joint and muscular disadvantages of conventional exercise equipment.

Therefore, a general object of this invention is to provide a chair that improves the strength and endurance of a user.

Another object of this invention is to provide a chair, as aforesaid, having an axis of rotation for repeated forward and backward rotational movements of a seat assembly.

Still another object of this invention is to provide a chair, as aforesaid, having pivot points aligned and configured to correspond with the axis of rotation of a user's knees and hips.

Yet another object of this invention is to provide a chair, as aforesaid, in which a fulcrum defining an axis of rotation of a seat assembly may be vertically adjusted relative to the hips of a user so as to increase or decrease operational resistance.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
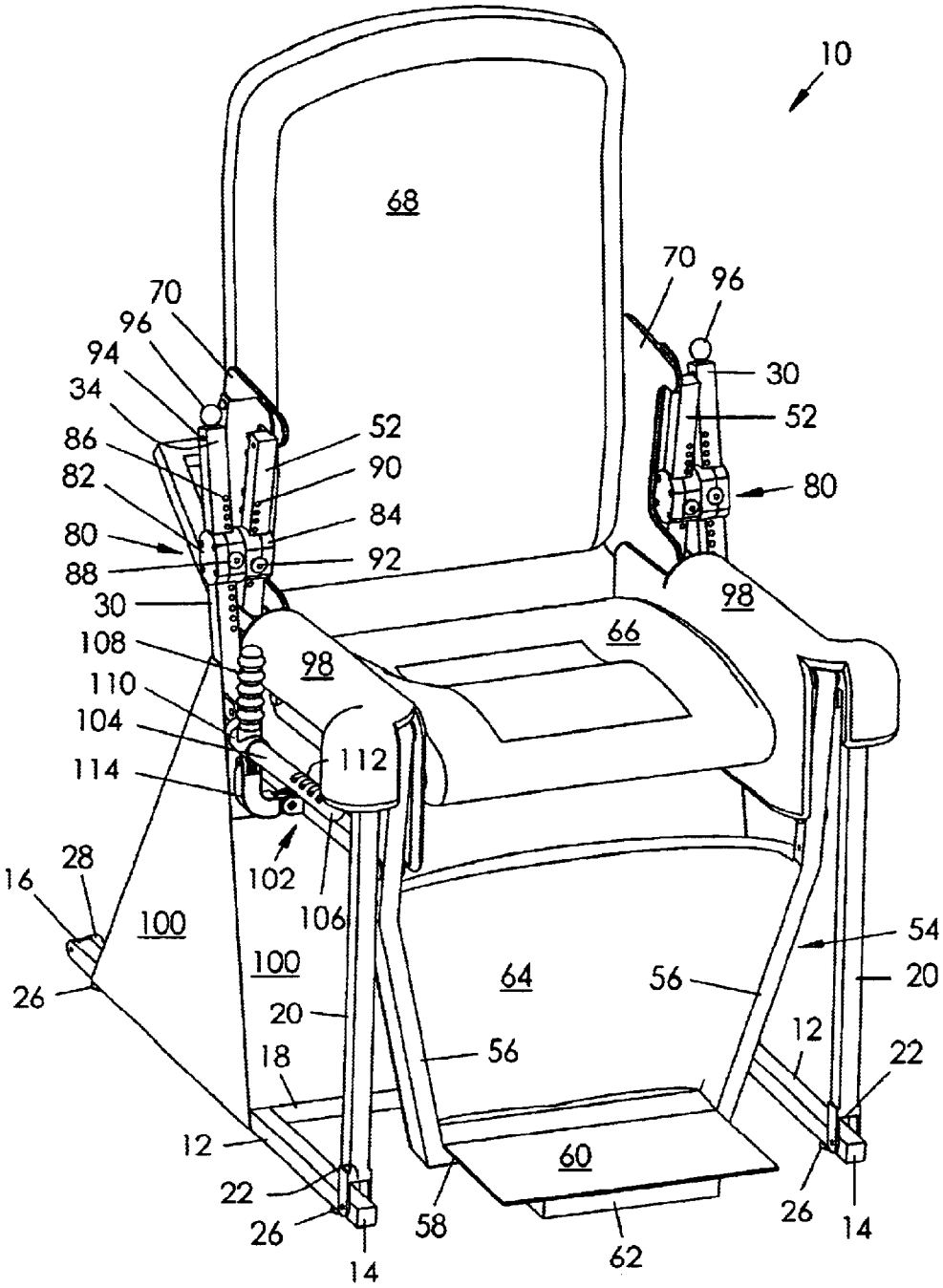
FIG. 1 is a perspective view of an exercise and rehabilitation chair according to an embodiment of the present invention.

A low-resistance exercise and rehabilitation chair according to the present invention will now be described in detail with reference to FIGS. 1 through 7 of the accompanying drawings. An exercise and rehabilitation chair 10 according to one embodiment of the present invention is shown in FIGS. 1 through 4 and includes a seat assembly rotatably coupled to a chair framework. More particularly, the chair framework includes a pair of laterally spaced apart lower frame members 12 configured to extend along a floor surface. The lower frame members 12 may be connected by struts 18 for stability (FIG. 3). Each lower frame member 12 includes opposed front 14 and rear 16 ends. The chair framework further includes a pair of generally upstanding front legs 20, each front leg having a lower end 22 pivotally coupled to a respective front end 14 of a respective lower frame member 12. This pivotal connection allows an upper end 24 (FIG. 3) of each front leg 20 to move simultaneously in forward and rearward directions during operation.

Level adjustment feet 26 are coupled to the bottom surfaces of the lower frame members 12 in spaced apart arrangement. In addition, at least a pair of wheels 28 are rotatably coupled to the lower frame members 12 adjacent respective rear ends 16 thereof (FIG. 3). Thus, the chair 10 may be tipped backwards and rolled upon the wheels 28 to a desired location.

Figure 2:
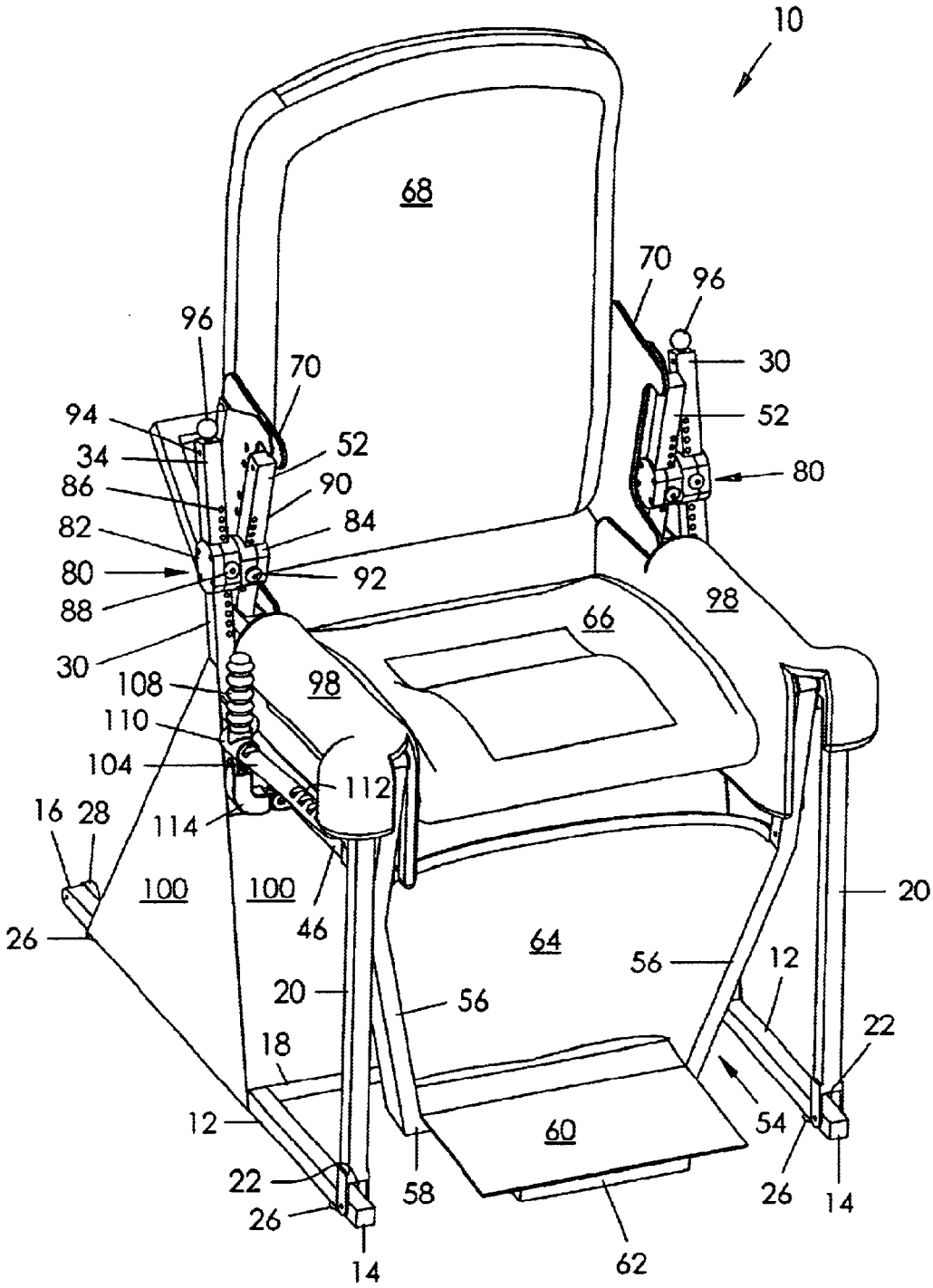
FIG. 2 is another perspective view of the chair as in FIG. 1 with the seat assembly in a rotated forward configuration.
Figure 3:
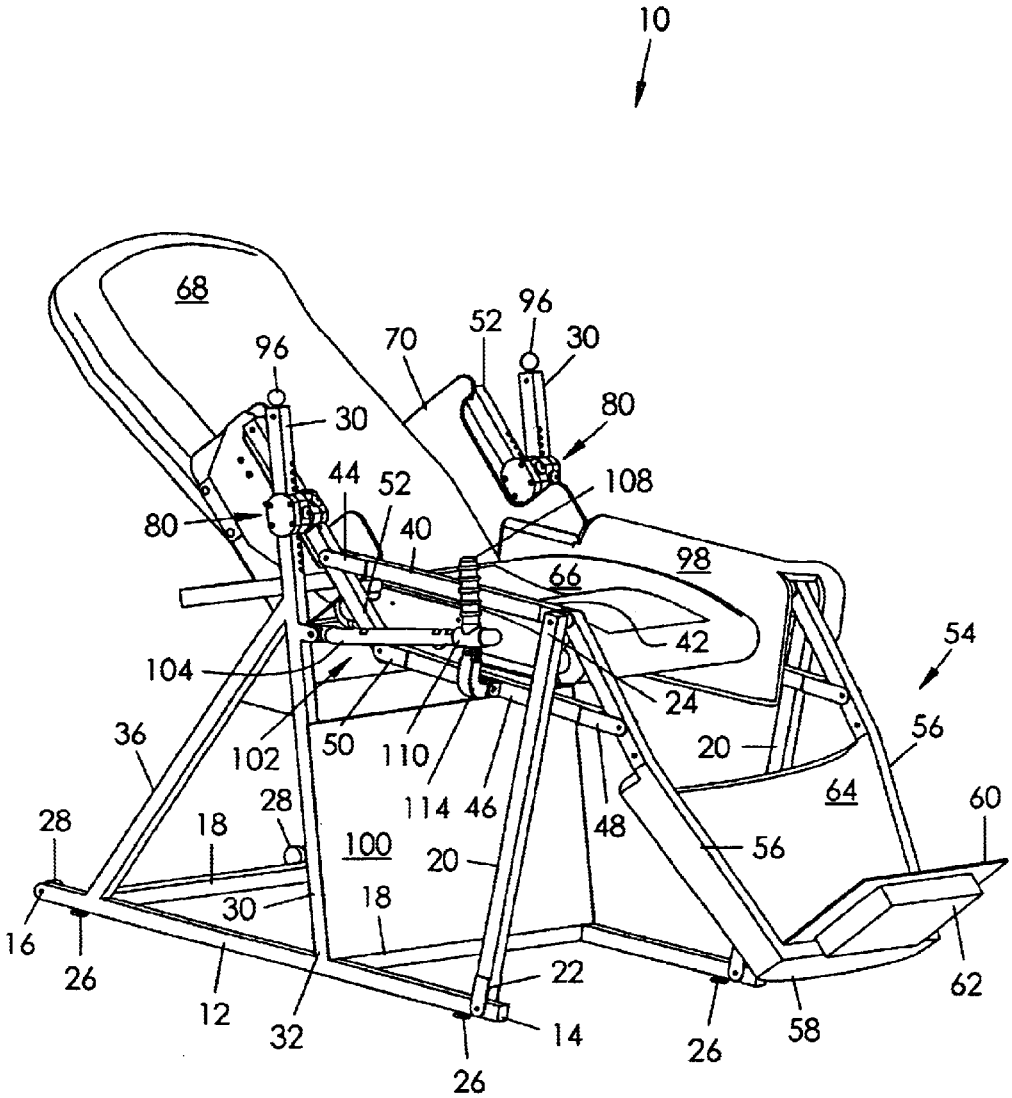
FIG. 3 is another perspective view of the chair as in FIG. 1 with the seat assembly in a rotated rearward configuration and with one armrest and side shield removed.

The chair framework further includes a pair of generally upstanding rear legs 30, each rear leg 30 having one end 32 fixedly attached to a respective lower frame member 12 at a point intermediate front 14 and rear 16 ends thereof and having an opposed free end 34 (FIG. 2). An auxiliary rear leg 36 extends between each rear leg 30 and a point adjacent a rear end 16 of a respective lower frame member 12 so as to form an A-frame support structure on each lower frame member 12 (FIG. 3).

As best shown in FIG. 3, the seat assembly includes pairs of upper 40 and lower 46 arms. Each upper arm 40 includes a front end 42 pivotally coupled to an upper end 24 of a respective front leg 20 with a bushing or similar fastener and includes a rear end 44. This point corresponds to the user's knee joint. Each lower arm 46 includes opposed front 48 and rear 50 ends. The seat assembly further includes a pair of generally upstanding support arms 52, each support arm having a lower end and an opposed free end. The lower end of each support arm 52 is pivotally coupled to a rear end 50 of a respective lower arm 46. A rear end 44 of each upper arm 40 is pivotally coupled to a respective support arm 52 at a point intermediate the lower and free ends thereof. This point corresponds to the user's hip joint.

The seat assembly includes a foot assembly 54 having a framework. The foot assembly framework includes a pair of lateral support bars 56, each lateral support bar being pivotally connected at one end to a front end 42 of a respective upper arm 40 of the seat assembly. Each lateral support bar 56 is further pivotally coupled to a front end 48 of a respective lower arm 46. The lateral support bars 56 are connected at opposed ends by a lower support bar 58. A planar foot plate 60 is attached to the lower support bar 58 and is configured to support the feet of a user. A weight 62 is fixedly attached to a bottom side of the foot plate 60 for counterbalancing the weight of the rearward portion of the seat assembly, as to be described more fully below. A shield 64 may also extend between the lateral support bars 56 so as to keep a user's feet properly positioned upon the foot plate 60 in operation. Further, it is contemplated that the foot plate 60 may be adjustable longitudinally along the lateral support bars 56 such that the chair 10 may be used by persons of various heights.

Therefore, each pair of upper 40 and lower 46 arms are pivotally coupled at respective ends to the foot assembly 54 and upstanding support arms 52 so as to form a parallelogram whose configuration changes in angular relationship during operation of the chair 10. Further, the seat assembly includes a padded seat bottom 66 fixedly attached to the upper arms 40. In addition, a seat back 68 is fixedly attached to the upstanding support arms 52 with mounting brackets 70.

Figure 4:
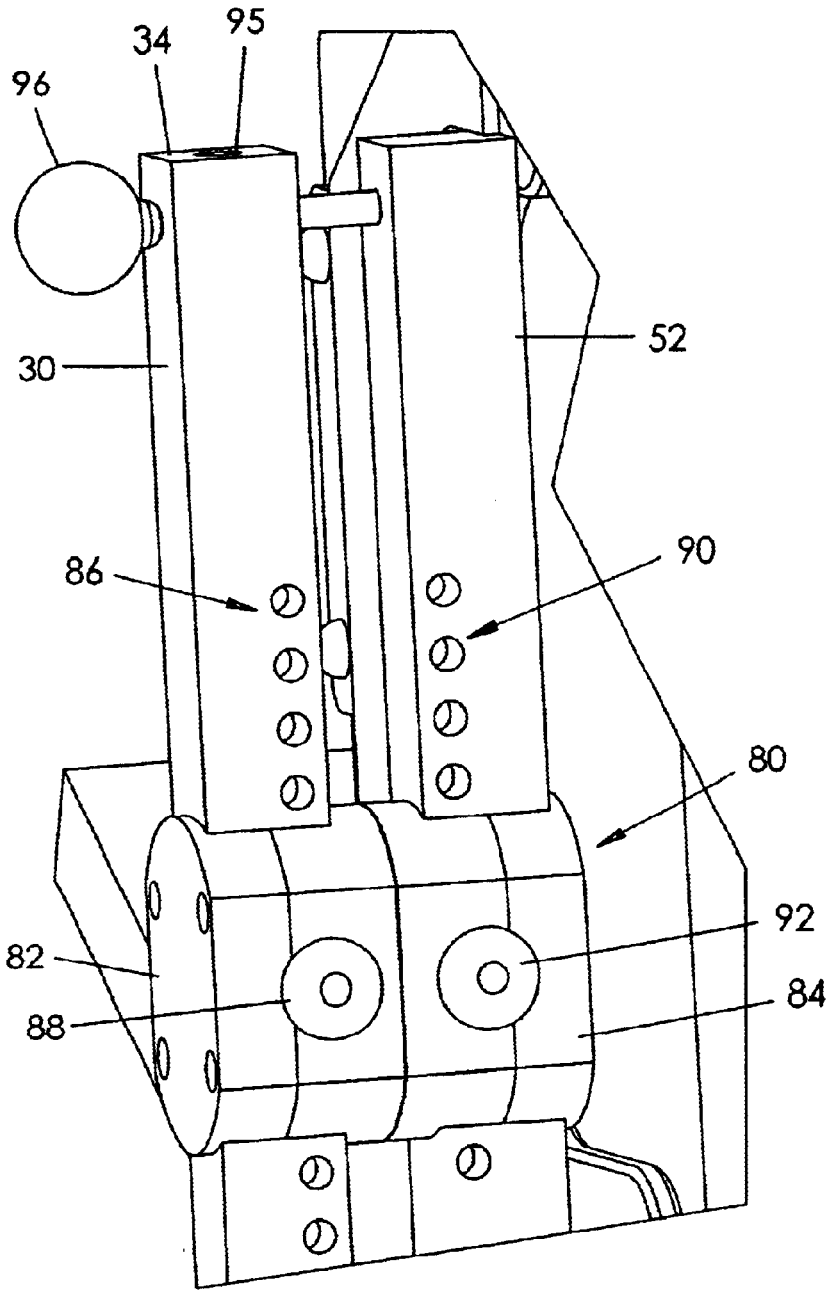
FIG. 4 is a fragmentary view on an enlarged scale of a bearing housing mounted to a rear leg and corresponding support arm while said rear leg and support arm are coupled together in a stationary configuration.

As best shown in FIG. 4, the chair 10 includes a pair of bearing housings 80, each bearing housing 80 having a first portion 82 mounted to a respective rear leg 30 and a second portion 84 mounted to an adjacent corresponding upstanding support arm 52. Each second portion 84 is pivotally coupled to a respective first portion 82 such that the second portions 84 of the bearing housings 80, through which respective support arms 52 of the seat assembly extend, establish a fulcrum about which the seat assembly may rotate, as to be described more fully later. Each bearing housing 80 is slidably movable along a corresponding rear leg 30 and support arm 52 combination. More particularly, each rear leg 30 defines a first plurality of holes 86 spaced apart longitudinally therealong and spaced from free ends 34 thereof. Correspondingly, a first pair of fasteners 88 extend through respective first portions of the pair of bearing housings 80 and are adapted to extend into a selected hole. Preferably, each first fastener 88 is a spring-loaded plunger pin biased to extend into a selected hole but that may be manually released therefrom by a user so as to slidably move a respective first portion 82 along a respective rear leg 30.

Similarly, each support arm 52 defines a second plurality of holes 90 spaced apart longitudinally therealong and spaced from free ends thereof. Correspondingly, a second pair of fasteners 92 extend through respective second portions of the pair of bearing housings 80 and are adapted to extend into a selected hole. The second pair of fasteners 92 are the same as those previously described.

It should be appreciated that corresponding first and second portions of a bearing housing 80 must be slidably moved together as corresponding portions are pivotally connected to one another. Further, the pair of bearing housings 80 should be positioned longitudinally at the same height such that the seat assembly is held in a level configuration. As discussed above, the bearing housings 80 define an imaginary horizontal axis extending therebetween so as to establish a fulcrum about which the seat assembly may rotate. This horizontal axis extends laterally across a vertical plane defined by the back of a user seated upon the seat bottom. Accordingly, moving this horizontal axis (fulcrum) up or down increases or decreases the resistance/difficulty of the chair's rotation, respectively. In other words, the closer the fulcrum is to a user's hips, the less resistance is encountered and vice versa. Preferably, the holes are configured so that the fulcrum may be adjusted from about three inches to about nine inches above a user's hips.

Each of the rear legs 30 and upstanding support arms 52 define laterally extending throughbores 94 (FIG. 1). Pins 96 may be extended through these bores 94 when corresponding rear legs 30 and support arms 52 are aligned in parallel and are stationary. Once secured, the seat assembly is held in a stable configuration. Pins 96 in FIG. 4 are used to secure the position and alignment of rear legs 30 and support arms 52 to allow the bearing housings 80 to be moved manually by pulling fasteners 88 and 92 simultaneously. When the pins 96 are removed, they may be stored in bores 95 extending longitudinally into free ends of the rear legs 30 (FIG. 4). It is understood that each pin 96 presents a length sufficient to act as a lever so as to raise and hold a corresponding support member 52 just enough to allow pins 88 and 92 to be released when adjusting the vertical position of a corresponding bearing housing 80. Of course, each pin 96 would be of sufficient length and diameter to accept the weight of the seat assembly while adjusting a corresponding bearing housing 80.

Further, the seat assembly includes a pair of padded armrests 98 adapted to overlay the upper arms 40 thereof. Preferably, the armrests 98 also overlay the connections of the upper arms 40 and front legs 20 and of the upper arms and lateral support bars of the foot assembly 54. While providing greater comfort to a user, the armrests 98 also serve to cover potential pinch points so as to avoid potential injury. Other pivotal connections are covered by shield panels 100.

The chair 10 further includes a handle assembly 102. The handle assembly 102 includes a support member 104 having a first end pivotally coupled to a respective rear leg 30 and extending forwardly to a free end 106. This pivot coupling allows for up/down movement of the support member 104. The handle assembly 102 includes an upstanding handle 108 fixedly attached to a sleeve 110, the sleeve being slidable along the support member 104. The handle 108 includes a biased member (not shown) for mating with a selected aperture 112 defined by the support member 104, the biased member being selectively disengaged upon a rotation of the handle 108. One end of a bracket 114 is pivotally coupled to the sleeve 110 with another end of the bracket 114 being pivotally coupled to a respective lower arm 46 of the seat assembly. These pivot connections are configured so as to allow the support member 104 to move along any axis according to movement of the seat assembly. The handle assembly 102 is used to lock the motion of the chair for safely sitting upon and standing up from the chair, and also to allow the user to lock the chair in a reclined position for resting in comfort while not exercising.

In operation, the seat assembly rests in a generally upright configuration when no user is seated therein, the weight 62 attached to the foot plate 60 counterbalancing the weight of the seat back 68 (FIG. 1). The handle assembly 102 is used to allow the user to lock and unlock the motion of the chair. When handle 108 is rotated, releasing the lock, the user is able to cause a rotational movement similar to that of a rocking chair and thus recline the chair 10 by pushing their feet gently on the foot plate 60 and leaning backward against the seat back 68 (FIG. 3). Releasing each of these pressures allows the seat assembly to rotate forwardly (FIG. 2). The difficulty (resistance) of causing the chair 10 to rotate as described above depends on the relative position of the bearing housing 80 above the user's hips. Resistance is reduced the closer the bearing housings are to the user's hips. Operation of the chair 10 causes low-resistance exercise and is gentle on a person's joints in that the pivot connections of the chair 10 correspond anatomically with the joints of the user's body.

Figure 5:
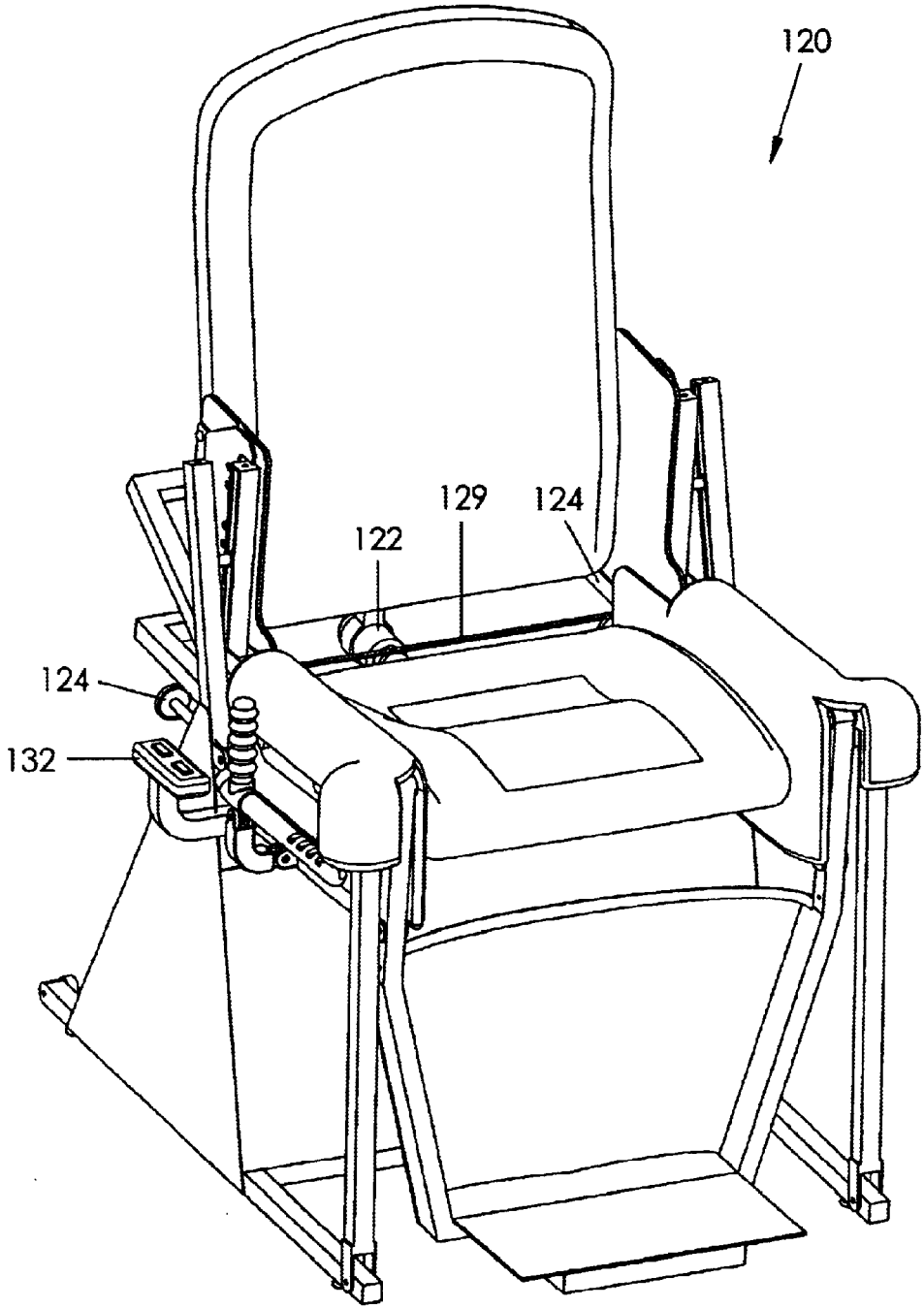
FIG. 5 is a perspective view of an exercise and rehabilitation chair according to another embodiment of the present invention.
Figure 6:
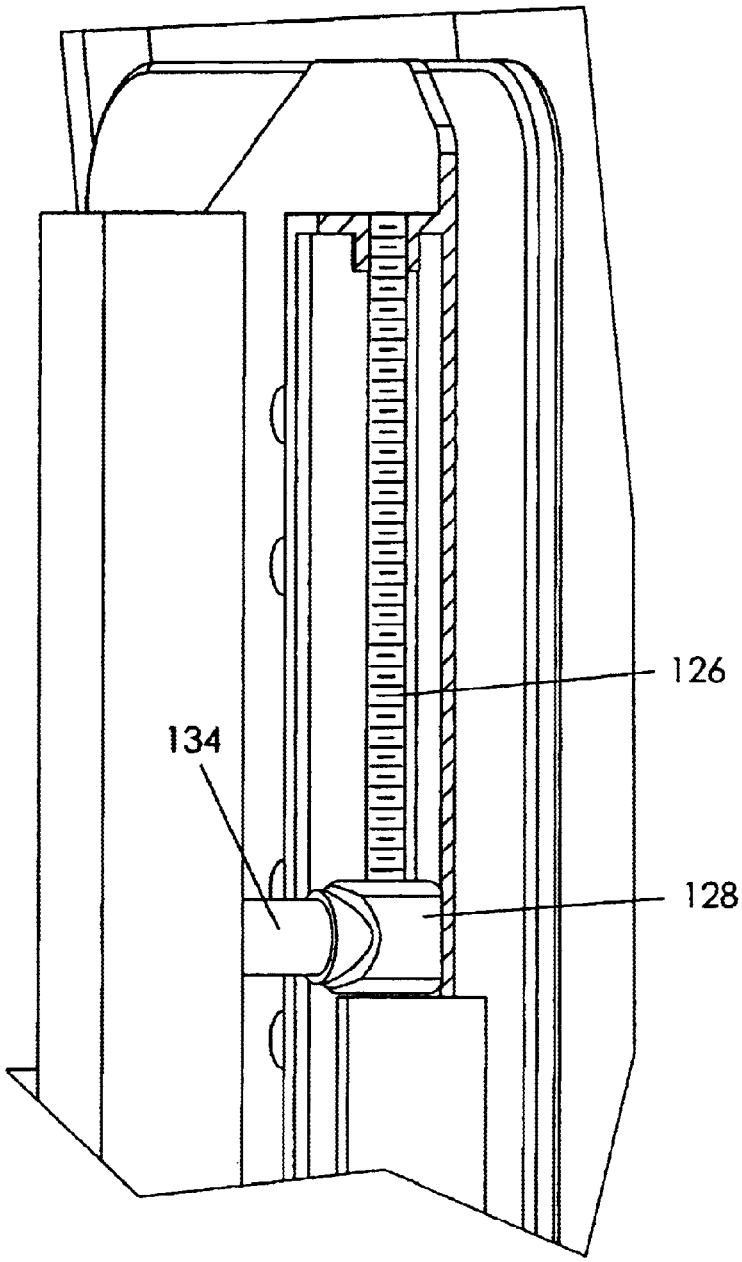
FIG. 6 is a fragmentary view on an enlarged scale of a jackscrew assembly of the chair as in FIG. 5.
Figure 7:
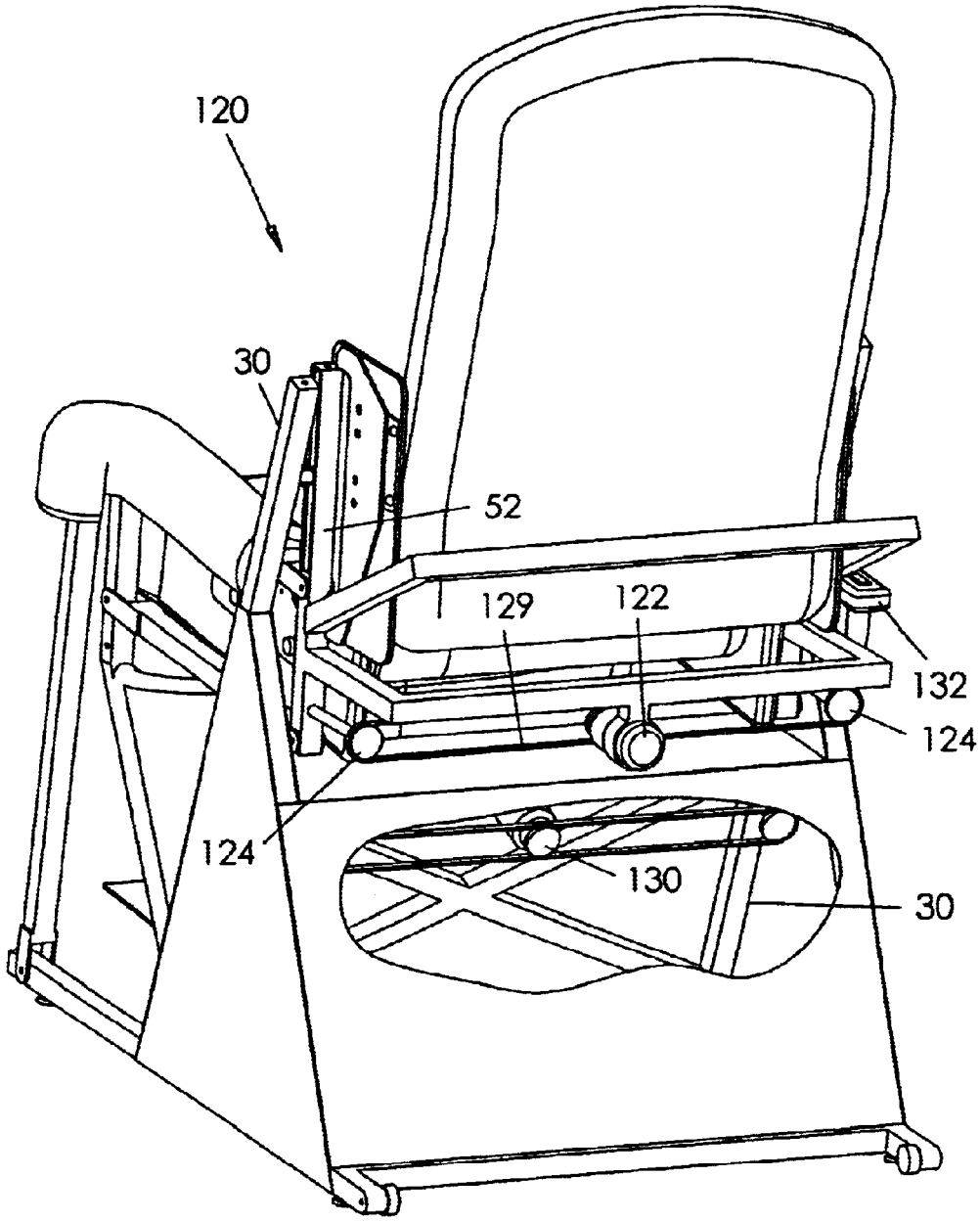
FIG. 7 is a rear perspective view of the chair as in FIG. 5 with a rear shield partially removed.

Another embodiment 120 of the present invention is shown in FIGS. 5 through 7 and includes a construction substantially similar to the construction described above except as specifically noted below. In this embodiment, a first jackscrew assembly is associated with each upstanding support arm 52 and is operated by a first motor 122. A second jackscrew assembly is associated with each rear leg 30 and is operated by a second motor 130. Operation of the jackscrew assemblies adjusts the fulcrum about which the seat assembly rotates. More particularly, each first jackscrew assembly includes a first gear 124 rotatably coupled to a respective support arm 52. Each of the first gears 124 is coupled to the first motor 122 with a first belt 129. Within a respective support arm 52, a respective first gear 124 meshes with a first jackscrew 126 which extends longitudinally therein, an operation of a first gear 124 causing the first jackscrew 126 to rotate about a longitudinal axis. Consequently, this jackscrew rotation causes a first adjustment bracket 128, that is in mating engagement with the threads of the first jackscrew 126, to be moved up or down therealong, depending on the direction of jackscrew rotation. The first motor 122 may be operated by a user utilizing the control panel 132 (FIG. 5). The motors may be powered using a conventional AC power connection (not shown). It is understood that operation of the first motor 122 operates the first jackscrew assemblies in unison.

The second jackscrew assembly includes a construction substantially similar to the construction of the first jackscrew assembly described above. The second jackscrew assembly is associated with the rear legs 30; thus, second jackscrews and second adjustment brackets are situated within respective rear legs. A fulcrum shaft 134 is coupled to corresponding first and second adjustment brackets so as to allow respective support arms 52 to rotate about the fulcrum shaft relative to corresponding rear legs 30 in a manner substantially similar to that described previously. It should be appreciated that the first 122 and second 130 motors operate simultaneously to adjust respective adjustment brackets. Therefore, an operation of the motors causes the fulcrum to be selectively raised or lowered so as to increase or decrease resistance of operation, respectively. It is understood that other motorized gear linkage arrangements could alternatively be employed for raising or lowering the fulcrum shafts.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A low resistance exercise and rehabilitation chair, comprising:

a pair of laterally spaced apart lower frame members extending along a floor surface, each lower frame member having opposed front and rear ends;

a pair of upstanding front legs, each front leg having a lower end pivotally coupled to a respective front end of a respective lower frame member and having an opposed upper end;

a pair of upstanding rear legs, each rear leg having one end fixedly attached to said respective lower frame member and having an opposed free end; and a seat assembly having a pair of arms, each arm having a front end pivotally coupled to a respective upper end of a respective front leg, each arm having a rear end pivotally coupled to a respective rear leg to define a fulcrum about which said seat assembly may rotate, said seat assembly including a seat bottom fixedly attached to said pair of arms and a seat back pivotally coupled to said rear ends of said arms.

2. The chair as in claim 1 further comprising means for vertically adjusting said fulcrum relative to said seat bottom.

3. The chair as in claim 1 wherein:

said seat assembly includes a pair of generally upstanding support arms, each support arm having a lower end pivotally coupled to a respective rear end of a respective arm and having an opposed free end;

a pair of bearing housings, each bearing housing having a first portion mounted to a respective rear leg and a second portion mounted to a respective support arm, each second portion being pivotally coupled to a respective first portion; and means for selectively securing said pair of bearing housings at desired longitudinal configurations along respective rear legs and support arms.

4. The chair as in claim 3 further comprising means for releasably securing said pair of support arms in fixed configurations parallel to corresponding rear legs.

5. The chair as in claim 1 further comprising a foot assembly having a framework pivotally coupled to said front ends of said pair of arms, said foot assembly having a foot plate fixedly attached to said framework.

6. The chair as in claim 5 further comprising a weight attached to a bottom surface of said foot plate, whereby to counterbalance a weight of said seat back when said seat assembly is not occupied by a user.

7. The chair as in claim 1 further comprising:

a pair of wheels rotatably coupled to respective rear ends of said pair of lower frame members; and a pair of padded armrests coupled to respective arms of said seat assembly and adapted to cover said respective arms and respective upper ends of said pair of front legs.

8. The chair as in claim 1 further comprising a handle assembly pivotally coupled to a corresponding rear leg, said handle assembly having an upstanding handle member situated adjacent a corresponding arm of said seat assembly.

9. A chair for low-resistance exercise and rehabilitation, comprising:

a pair of laterally spaced apart lower frame members adapted to extend along a floor surface, each lower frame member having opposed front and rear ends;

a pair of upstanding front legs, each front leg having a lower end pivotally coupled to a respective front end of a respective lower frame member and having an opposed upper end;

a pair of upstanding rear legs, each rear leg having one end fixedly attached to said respective lower frame member and having an opposed free end;

a seat assembly having a pair of upper arms, each upper arm having a front end pivotally coupled to a respective upper end of a respective front leg and having a rear end pivotally coupled to an upstanding support arm, said seat assembly including a seat bottom fixedly attached to said pair of upper arms and a seat back pivotally coupled to respective rear ends of said upper arms;

a pair of bearing housings, each bearing housing having a first portion mounted to a respective rear leg and a second portion mounted to a respective support arm, each second portion being pivotally coupled to a respective first portion;

means for selectively securing said pair of bearing housings at desired longitudinal configurations along respective rear legs and corresponding support arms;

wherein said pair of bearing housings define an imaginary horizontal axis extending therebetween so as to establish a fulcrum about which said seat assembly may rotate, said horizontal axis extending laterally across a vertical plane defined by the back of a person seated upon said seat bottom; and a foot assembly having a framework pivotally coupled to said front ends of said pair of upper arms, said foot assembly having a foot plate fixedly attached to said framework.

10. The chair as in claim 9 wherein said means for selectively securing said pair of bearing housings includes:

a first plurality of holes defined by said respective rear legs and spaced apart longitudinally therealong; and a first pair of fasteners adapted to releasably extend through respective first portions of respective bearing housings and into respective holes of said first plurality of holes, said first pair of fasteners being biased to releasably hold said respective first portions of respective bearing housings at selected configurations.

11. The chair as in claim 10 wherein said means for selectively securing said pair of bearing housings includes:

a second plurality of holes defined by respective support arms of said seat assembly and spaced apart longitudinally therealong; and a second pair of fasteners adapted to releasably extend through respective second portions of said respective bearing housings and into respective holes of said second plurality of holes, said second pair of fasteners being biased to releasably hold said respective second portions of said respective bearing housings at selected configurations.

12. The chair as in claim 9 further comprising means for releasably coupling respective free ends of said pair of rear legs to respective support arms so as to releasably hold said seat assembly in a stationary configuration.

13. The chair as in claim 9 further comprising a weight member attached to a bottom surface of said foot plate, whereby to counterbalance a weight of said seat back for stabilizing said seat assembly when not occupied by a user.

14. The chair as in claim 9 further comprising a pair of padded armrests adapted to overlay respective upper arms and respective upper ends of said pair of front legs.

15. The chair as in claim 9 further comprising a pair of wheels rotatably coupled to respective rear ends of said pair of lower frame members.

16. The chair as in claim 9 wherein said seat assembly includes:

a pair of lower arms, each lower and having a front end pivotally coupled to said foot assembly and a rear end pivotally coupled to a respective support arm; and a handle assembly, said handle assembly including a support rod having a first end pivotally coupled to a corresponding rear leg and an opposed free end pivotally coupled to a corresponding lower arm, said handle assembly including a handle slidably coupled to said support rod and adapted to move longitudinally therealong.

17. The chair as in claim 9 wherein said foot assembly includes means for selectively displacing said foot plate from a support member of said framework.

* * * * *